US012702197B2

(12) United States Patent
Susko et al.

(10) Patent No.: US 12,702,197 B2
(45) Date of Patent: Aug. 11, 2026

(54) CONSTRUCTION OF A VARIABLE FRICTION SHOE

(71) Applicant: The Regents of the University of California, Oakland, CA (US)

(72) Inventors: Tyler Susko, Goleta, CA (US); Elliot Hawkes, Goleta, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 18/696,686

(22) PCT Filed: Sep. 29, 2022

(86) PCT No.: PCT/US2022/045228
§ 371 (c)(1),
(2) Date: Mar. 28, 2024

(87) PCT Pub. No.: WO2023/055933
PCT Pub. Date: Apr. 6, 2023

(65) Prior Publication Data

US 2024/0373982 A1 Nov. 14, 2024

Related U.S. Application Data

(60) Provisional application No. 63/249,665, filed on Sep. 29, 2021.

(51) Int. Cl.
*A43B 13/22* (2006.01)

(52) U.S. Cl.
CPC ..... *A43B 13/22* (2013.01)

(58) Field of Classification Search
USPC ..... 36/59 C, 130, 8.3
See application file for complete search history.

(56) References Cited

U.S. PATENT DOCUMENTS 3,195,244 A 7/1965 Whitcas
3,672,077 A 6/1972 Coles
(Continued)

FOREIGN PATENT DOCUMENTS

EP 3945924 A1 2/2022
JP 11137305 H 5/1999
(Continued)

OTHER PUBLICATIONS

"Extended European Search Report Mailed on Dec. 5, 2022", 7 Pages.

(Continued)

*Primary Examiner* — Matthew R Marchewka
(74) *Attorney, Agent, or Firm* — Billion & Armitage

(57) ABSTRACT

A variable friction shoe sole includes a midsole body, one or more compressible portions made of a compressible material, one or more low-friction portions vertically aligned with the one or more compressible portions, and one or more intermediate layers located between the one or more low-friction portions and the one or more compressible portions. The one or more low-friction portions are prominent of the midsole body when vertical ground reaction forces (GRFs) applied to the variable friction shoe sole are low, and wherein an increase in GRFs compresses the one or more compressible portions and causes the one or more low-friction portions to retract inwards.

16 Claims, 6 Drawing Sheets

(56) References Cited

U.S. PATENT DOCUMENTS

| | | | | |
|---|---|---|---|---|
| 4,056,106 | A | 11/1977 | Salvatore | |
| 4,083,125 | A | 4/1978 | Benseler et al. | |
| 4,141,158 | A | 2/1979 | Benseler et al. | |
| 4,667,423 | A | 5/1987 | Autry et al. | |
| 5,077,915 | A | 1/1992 | Gross | |
| 5,926,974 | A | 7/1999 | Friton | |
| 6,243,973 | B1 | 6/2001 | Lind | |
| 6,589,630 | B1 | 7/2003 | Crow | |
| 8,813,394 | B2 | 8/2014 | Weidman et al. | |
| 8,844,170 | B2 | 9/2014 | Ferrigan et al. | |
| 9,049,900 | B1 * | 6/2015 | Cox | A43B 1/0027 |
| 9,439,474 | B2 | 9/2016 | Braunschweiler | |
| 9,572,401 | B1 | 2/2017 | Haskins | |
| 2004/0055181 | A1 | 3/2004 | Gallegos | |
| 2004/0055182 | A1 | 3/2004 | Manz et al. | |
| 2006/0143947 | A1 | 7/2006 | Ellis et al. | |
| 2006/0277799 | A1 | 12/2006 | Lebo | |
| 2008/0110045 | A1 | 5/2008 | Terlizzi et al. | |
| 2010/0024252 | A1 | 2/2010 | Sveen | |
| 2010/0107448 | A1 * | 5/2010 | Fallow | A43B 5/12 36/103 |
| 2011/0302806 | A1 | 12/2011 | Auger et al. | |
| 2012/0144695 | A1 | 6/2012 | Mcdowell et al. | |
| 2012/0233885 | A1 | 9/2012 | Shaffer et al. | |
| 2012/0255204 | A1 * | 10/2012 | Iglesias | A43B 13/145 36/103 |
| 2012/0260535 | A1 | 10/2012 | Tsang | |
| 2012/0266500 | A1 | 10/2012 | Cobb | |
| 2013/0000153 | A1 | 1/2013 | Weidman et al. | |
| 2013/0036633 | A1 | 2/2013 | Lee | |
| 2013/0263469 | A1 | 10/2013 | Braunschweiler | |
| 2013/0263476 | A1 | 10/2013 | Santos et al. | |
| 2014/0283413 | A1 | 9/2014 | Christensen et al. | |
| 2014/0310986 | A1 | 10/2014 | Tamm et al. | |
| 2015/0196082 | A1 | 7/2015 | Van Atta | |
| 2015/0196087 | A1 | 7/2015 | Meschter et al. | |
| 2015/0237958 | A1 | 8/2015 | Cross | |
| 2015/0335095 | A1 | 11/2015 | Lee | |
| 2016/0192739 | A1 | 7/2016 | Hoffer et al. | |
| 2016/0219980 | A1 | 8/2016 | Taylor | |
| 2016/0278484 | A1 | 9/2016 | Aslani et al. | |
| 2016/0331067 | A1 | 11/2016 | Mccaffrey | |
| 2017/0042284 | A1 | 2/2017 | Lawless | |
| 2017/0318902 | A1 | 11/2017 | Schiller et al. | |
| 2018/0352906 | A1 | 12/2018 | Miller | |
| 2019/0104806 | A1 | 4/2019 | Cass et al. | |
| 2019/0110553 | A1 | 4/2019 | Yoshikawa et al. | |
| 2019/0223552 | A1 | 7/2019 | Hollinger | |
| 2019/0373980 | A1 | 12/2019 | Mariacher | |
| 2020/0008513 | A1 | 1/2020 | Yao et al. | |
| 2020/0077734 | A1 | 3/2020 | Bidal et al. | |
| 2020/0315293 | A1 | 10/2020 | Zhao et al. | |
| 2021/0015206 | A1 | 1/2021 | Boys et al. | |
| 2021/0267306 | A1 * | 9/2021 | Sakaguchi | A43B 13/14 |
| 2022/0192314 | A1 | 6/2022 | Susko et al. | |

FOREIGN PATENT DOCUMENTS

| | | | |
|---|---|---|---|
| JP | 2013539673 | A | 10/2013 |
| WO | 2017151388 | A1 | 9/2017 |
| WO | 2020206428 | A1 | 10/2020 |

OTHER PUBLICATIONS

"Non-Final Office Action Mailed on Nov. 23, 2022", 3 Pages.
"Notice of Allowance for U.S. Pat. No. 3,134,270 mailed on May 8, 2024", 1.
"Office action Received mailed on Jul. 27, 2023", 3 Pages.
"PCTUS2245228_PCTIB326_Apr. 11, 2024", 8 Pages.
PCT/US20/26881 , "International Search Report and Written Opinion", Jul. 16, 2020, 8 Pages.
PCT/US20200/26881 , "International Search Report and Written Opinion", Sep. 9, 2020, 9 pages.
PCT/US22/45228 , "International Search Report and Written Opinion", Dec. 30, 2022, 13 pages.
"Communication Pursuant to Article 94(3) EPC mailed on Dec. 11, 2025", 6 Pages.

* cited by examiner

CONSTRUCTION OF A VARIABLE FRICTION SHOE

CROSS REFERENCE TO RELATED APPLICATIONS

This application claims the benefit of and priority to U.S. provisional application 63/249,665, titled "CONSTRUCTION OF A VARIABLE FRICTION SHOE", filed on Sep. 29, 2021, the contents of which are incorporated by reference herein.

BACKGROUND

The present invention is related to footwear designed to aid those suffering from gait impairments that makes it difficult to clear the floor during the swing phase of gait, one such impairment is foot drop but may relate broadly to any gait impairment. Foot Drop is a mobility disorder that limits ankle dorsiflexion, complicating the swing phase of gait and balance. It is a common result of a neurological injury or disease such as stroke, cerebral palsy, peripheral nerve disease, brain tumor or multiple sclerosis. While symptoms of stroke, multiple sclerosis, brain tumors, peripheral nerve disease and cerebral palsy vary from patient to patient, a subset of patients in each group will experience foot drop, characterized by the inability to dorsiflex, or lift the toes toward the shin, due to impaired control of the tibialis anterior and/or the triceps surae. It inhibits the rhythmic swing phase of gait, increases the probability of foot scuff and falls, and forces conscious monitoring of one's gait, typically manifesting into abnormal gait patterns.

Assistive technology refers to devices meant to aid a person in desirable tasks. For walking, available devices include functional electrical stimulation (FES) applied to the tibialis anterior muscle or a static ankle-foot orthosis (AFO). Rehabilitation technology refers to devices meant to restore healthy movement via use of the technology. Robotic rehabilitation devices are beginning to target populations with foot drop. For example, researchers at Massachusetts Institute of Technology (MIT) developed the MIT-Skywalker which allows free motion during the swing phase of gait, temporarily restoring rhythmicity originally lost due to inability to clear the floor. The Skywalker and other robotic rehabilitation devices, while promising, have three areas for improvement: cost, complexity and portability. Rehabilitation is most effective with repetition. A device that a patient could own or at least use regularly outside of clinical visits would allow for a higher volume of rehabilitation training. Currently, there is not a rehabilitative solution that is cost effective and practical for every day independent use.

SUMMARY

According to one aspect, a variable friction shoe sole includes a midsole body, one or more compressible portions comprised of a compressible material, one or more low-friction portions vertically aligned with the one or more compressible portions, and one or more intermediate layers located between the one or more low-friction portions and the one or more compressible portions. The one or more low-friction portions are prominent of the midsole body when vertical ground reaction forces (GRFs) applied to the variable friction shoe sole are low, and wherein an increase in GRFs compresses the one or more compressible portions and causes the one or more low-friction portions to retract inwards.

According to another aspect, a variable friction shoe may include an upper portion, a midsole body connected to the upper portion, the midsole body having a bottom surface that defines a first plane. The shoe may further include one or more compressible portions located adjacent to the midsole body and one or more low-friction portions vertically aligned with the one or more compressible portions. The shoe may further include one or more intermediate layers located between the one or more compressible portions and the one or more low-friction portions, wherein the one or more low friction portions extend below the plane defined by the bottom of the midsole body when zero ground reaction forces (GRFs) are applied to the bottom of the shoe and wherein the one or more low friction portions retract above the plane defined by the bottom of the midsole body in response to a threshold level of GRFs are applied to the bottom of the midsole body.

According to another aspect, the variable friction shoe sole may include a midsole body, one or more sections of a compressible material that compresses more easily than the midsole body, and one or more sections of a low-friction material assembled such that the low friction material sits beneath the portions of the sole containing the compressible material. The low-friction material may contact the ground when the sole is in an approach angle of up to 75 degrees.

DETAILED DESCRIPTION

According to some aspects, a variable friction shoe is disclosed herein that provides variable levels of friction with the ground during various gait stages. For purposes of this discussion, the gait is divided into the swing phase and the stance phase. During the swing phase the variable friction shoe presents a low-friction surface that protrudes or extends from the outsole of the shoe, which permits sliding between the shoe and the ground. The outsole of the shoe is defined as the outer most surface of the sole contacting the ground. During the stance phase of the gait the variable friction shoe presents a higher-friction surface at the outsole of the shoe to prevent slipping with respect to the ground. In some embodiments, the outsole of the variable friction shoe includes a bottom surface configured to provide contact between the shoe and the ground, wherein the bottom surface is a high-friction surface. For example, the bottom surface may utilize materials and geometries such as treads to provide a high-friction surface. In some embodiments, presenting the low-friction surface or high-friction surface during different portions of the gait is accomplished by including compressible material adjacent to the low-friction material. During the swing portion of the gait, when vertical ground reaction forces (GRFs) are low, the compressible material is in an uncompressed state allowing the low-friction material to protrude from the higher-friction surface of the sole. As a result, any accidental contact with the ground (e.g., scuff events) as the foot swings forward during the swing portion of the gait results in the low-friction material coming into contact with the ground. The low coefficient of friction associated with the low-friction material results in the shoe sliding along the ground during a scuff event and does not catch and/or cause the user to fall. During the stance phase of the gait, when vertical GRFs are high, the compressible material is in a compressed state that causes the low-friction material to recede within the higher-friction surface of the sole such that a higher-friction surface is put into contact with the ground. The higher-friction surface provides the grip desired during the stance phase of the gait. For clarity, low-friction refers to a material that has a low coefficient of friction between the low-friction material and the ground. Higher-friction refers to a material that has a higher coefficient of friction between the higher-friction material and the ground than the coefficient of friction between the low-friction material and the ground.

Figure 1:
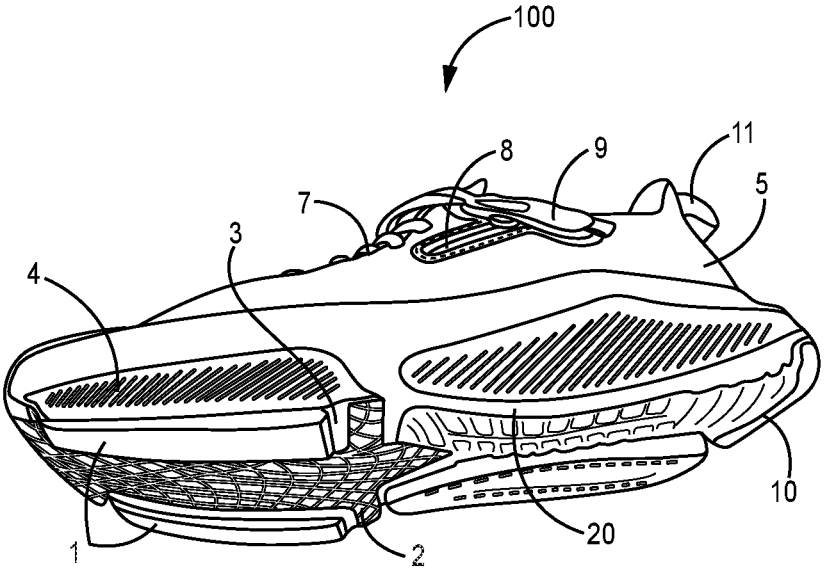
FIG. 1 is an exemplary underside perspective view of a variable friction shoe.
Figure 2:
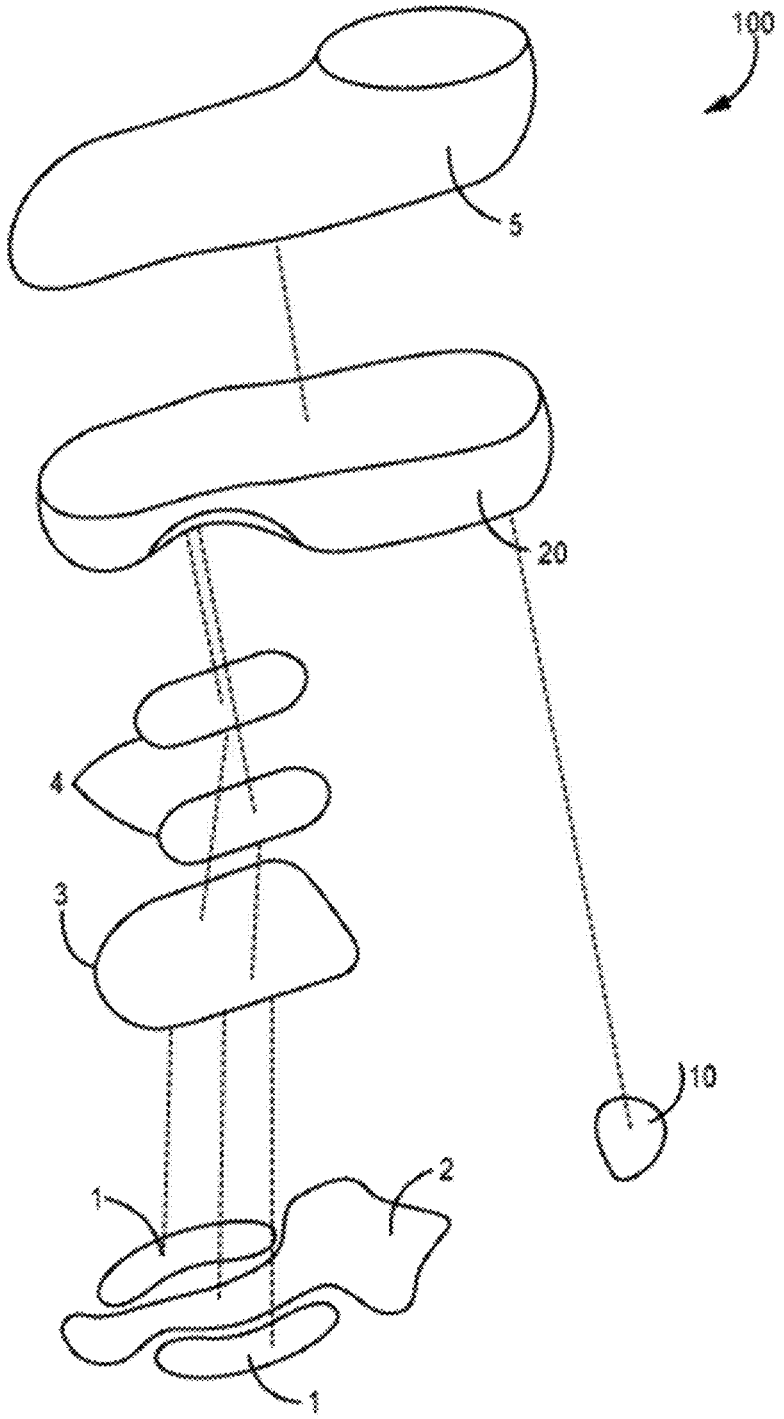
FIG. 2 is an exemplary exploded view of a variable friction shoe.

FIG. 1 is a perspective view of an example embodiment of a variable friction shoe 100 and FIG. 2 shows an exploded view. The shoe includes an upper portion 5 and a sole 50. In some embodiments, the sole 50 includes a midsole body 20, one or more sections of a compressible material 4, one or more intermediate layers 3, a high-friction material 2, and one or more sections of a low friction material 1. In some embodiments, the midsole body 20 and/or one or more intermediate layers 3 may be comprised of a high-friction materials (relative to the low-friction material 1), wherein a separate high-friction material 2 is not required. In some embodiments, a high-friction material 2 can be added that assembles to the bottom of the shoe underneath the intermediate layer 3 such that the high-friction material 2 will come into contact with the ground (assuming the low-friction material 1 has receded due to the application of GRFs). In some embodiments, the high-friction material 2 can extend beyond the intermediate layer 3. For example, in some embodiments the high-friction material 2 may extend one or more of forward, aft, left or right (i.e., in the medial-lateral direction) of the intermediate layer 3. In some embodiments, the compressible material 4 is located vertically adjacent to the low-friction material 1 such that pressure applied to the low-friction material 1 results in compression of the compressible material 4. However, in some embodiments the compressible material 4 can extend beyond the bounds of the low-friction material 1 area. In some embodiments the sole 50 may include additional rear high-friction patches 10 as seen in FIG. 1, the additional rear high-friction patches 10 being used to prevent slipping on heel strike when the shoe is tilted upward such that the middle of the midsole body is at an elevation higher than the rear portion of the midsole body. In some embodiments, the upper portion 5 may include elastic straps 7, a zipper 8, a VELCRO® strap (e.g., hook and loop fastener) 9 and rear loop 11 for ease of donning and removing the shoe.

In some embodiments, the construction of the variable friction shoe 100 benefits from an intermediate layer 3 between the compressible material 4 and the low-friction material 1. The compressible material can be made from a variety of materials as long as the compressible material is easier to compress than the midsole body 20. The compressible material 4 and the low-friction material 1 may be made from the same material, wherein the geometry of the compressible material 4 is altered relative to the low-friction material 1. For example, the compressible material 4 may be comprised of a material organized into a lattice structure and the low-friction material 1 from the same material but in a different structure. Similarly, the compressible material 4 and the midsole body 20 can be made from the same material or from the same mold by altering the compliance or porosity of the combined unit in localized regions of the assembly. In some embodiments, the compressible materials 4 may be fabricated utilizing soft foams, composite materials, or porous or lattice structure versions of stiffer materials, as well as other known materials providing the desired compressibility. Soft foams are simple and are durable in compression but not durable in tension and in shear. In some embodiments, if the compressible material 4 is fabricated using a soft foam (or other similar type of material), it may be beneficial to have a durometer between 1 and 45 on the Shore A scale. Regardless of the compressible material used, the compressible material 4 deforms easily, and, in some embodiments, the low-friction material 1 will not, which can create regions of stress concentrations near the edges or interface between the low-friction material 1 and compressible material 4. In some embodiments, the intermediate layer 3 is placed between the low-friction material 1 and the compressible material 4 to prevent is made of a material that will not tear from shear loading. The intermediate layer 3 can be made to be elastic or inelastic material. An example embodiment may nylon fabric as the intermediate layer 3.

The low-friction material 1 exhibits a low coefficient of friction between the low-friction material 1 and the ground 16. A low coefficient of friction is defined as a coefficient of friction below that of the coefficient of friction between standard shoe midsole material EVA foam and the ground. In some embodiments, the low coefficient of friction is defined relative to the high-friction material 2, wherein the coefficient of friction associated with the low-friction material 1 is less than a coefficient of friction associated with the high-friction material 2. The low-friction material 1 can be made from a variety of materials. Examples include but are not limited to plastics, metals, woods or ceramics. In some embodiments, the low-friction material 1 is Polytetrafluoroethylene (PTFE), a type of synthetic fluoropolymer of tetrafluoroethylene that exhibits a very low coefficient of friction between many surfaces. In other embodiments, other materials or combination of materials, including Nylon, Acetal, and others may be utilized in the low-friction material 1.

Figure 7:
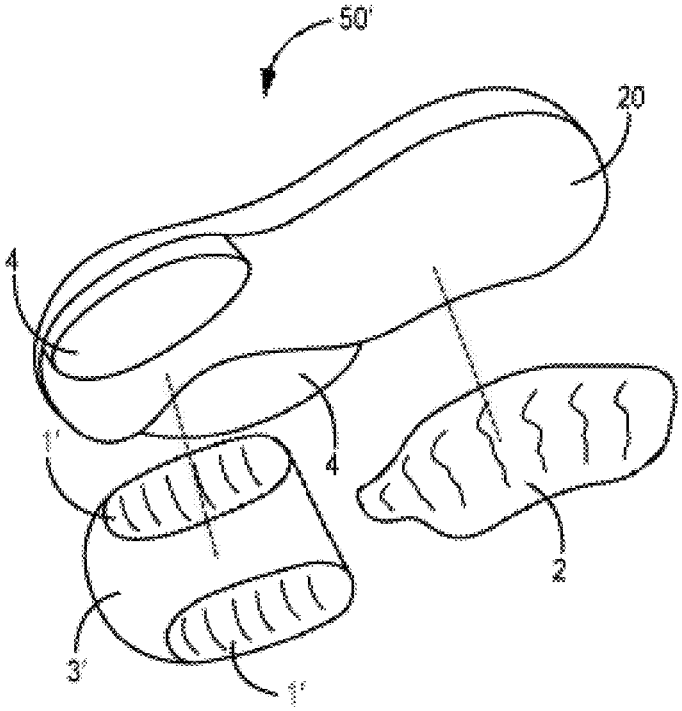
FIG. 7 is an exemplary exploded view of an exemplary sole demonstrating. a combined single-piece intermediate layer and low-friction material.

The connection between the intermediate layer 3 and the low-friction material 1 can be made with any joining method including but not limited to chemical adhesives, mechanical fasteners such as screws or rivets, welding, ultrasonic welding. As seen in FIG. 7, the intermediate layer 3 and the low-friction material 1 can be formed out of a single piece. For example, the intermediate layer 3 can be a thin piece of material which can also serve as the low-friction material 1. In one embodiment, the intermediate layer 3 and the low-friction material 1 are comprised of an integral molded piece of plastic. In another embodiment, the intermediate layer 3 and the low-friction material 1 are fabricated utilizing an over-molding process is utilized to inject multiple materials into the integral component representing the low-friction material 1 and the intermediate layer 3. In some embodiments, over-molding processes allow different parts of the same component to exhibit different properties (e.g., differences in compression, coefficients of friction, etc.). In another embodiment, the intermediate layer 3 and the low-friction material 1 are comprised of an integral piece of metal.

In some embodiments, the midsole body 20 has the durometer of standard running shoes. For example, in some embodiments the midsole body 20 has a durometer of between 30 and 100 on the Shore A scale.

In some embodiments, the high-friction material 2 is made from a material that has a high coefficient of friction between the high-friction material and the ground. In particular, the high-friction material 2 is defined by a coefficient of friction that is higher than the coefficient of friction of the low-friction material 1. In some embodiments, the high-friction material 2 is comprised of rubber and may include treads to further increase the coefficient of friction. In some embodiments, this high-friction material 2 may be omitted if the intermediate layer 3 selected has a sufficiently high coefficient of friction. In this example, the intermediate layer 3 would be comprised of a material having a higher coefficient of friction than the low-friction material 1.

As described above, during the swing phase of the gait the ground reaction forces (GRFs) are low because the variable friction shoe 100 is not in contact with the ground (or at least not in contact such that significant GRFs are experienced). As a result, the compressible portions 4 are in an uncompressed state such that the low-friction portions 1 protrude or extend from the outsole of the shoe 100, which permits sliding between the shoe 100 and the ground. During the stance stage of the gait, the GRFs increase due to the weight of the user and the compressible portions 4 are compressed. With the compressible material in a compressed state, the low-friction portions 1 recede within the higher-friction surface 2 of the sole such that a higher-friction surface 2 is put into contact with the ground. The higher-friction surface 2 provides the grip desired during the stance phase of the gait.

Figure 3:
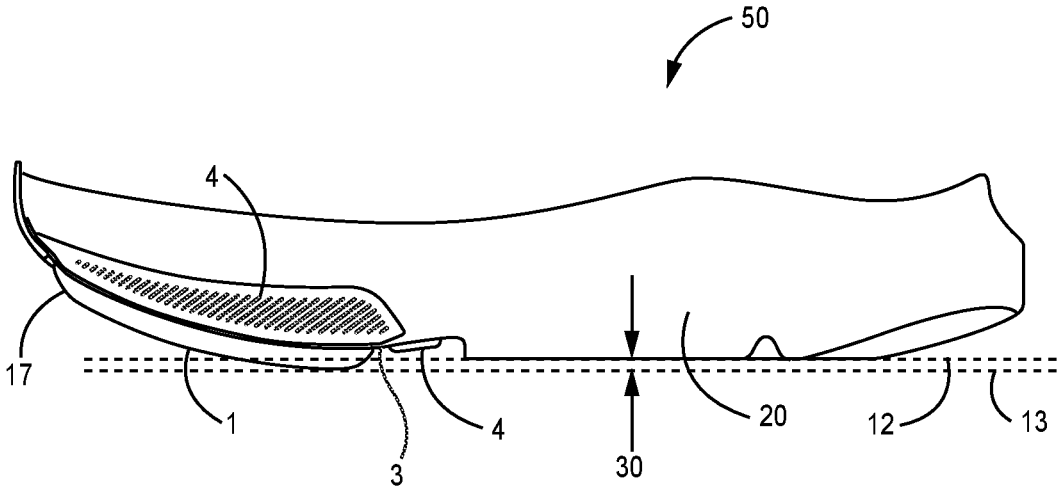
FIG. 3 is a side view of an exemplary sole.

FIG. 3 is a side view of the sole 50 in a horizontal, resting position with little to no ground reaction forces applied to the sole 50. With zero GRFs, the variable friction shoe is constructed such that the low-friction material 1 protrudes beyond the rest of the shoe sole. FIG. 3 shows a horizontal line 12 that aligns with the bottom of the midsole body 20 and horizontal line 13 aligned with the bottom portion of the low-friction material 1. A gap 30 between the horizontal line 12 and the horizontal line 13 illustrates the protrusion of the low-friction material 1 below that of the midsole body 20. This protrusion exists along the body of the low-friction material 1 as it moves up to the leading edge 17 of the low friction material to ensure that during a scuff event when the sole contacts the ground during the swing phase, the low-friction material 1 contacts the floor before a higher friction surface makes contact. During the stance phase of the gait (not shown in this view), the GRFs increase along the length of the sole 50. The increase in GRFs causes the compressive material 4 to become compressed, which causes the low-friction portions 1 to recede such that the midsole body 20 and/or high-friction material 4 is brought into contact with the ground.

Figure 4:
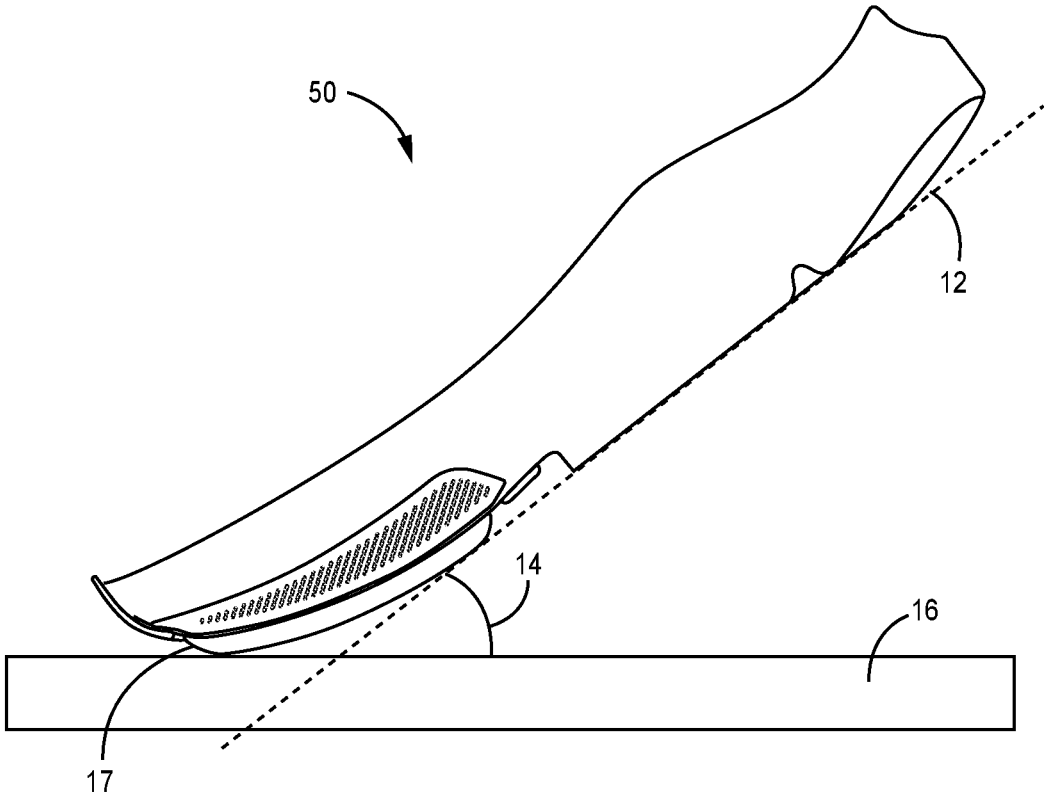
FIG. 4 is side view of an exemplary sole showcasing an approach angle.

FIG. 4 is side view of an exemplary sole showcasing an approach angle 14 that exists at the initiation of the swing phase of the gait. A patient or user suffering from foot drop will typically exhibit a non-zero approach angle 14 during the swing phase of the gait. In some embodiments, the low-friction material 1 is positioned to ensure contact with the ground during a swing phase of the gait given a non-zero approach angle as shown in FIG. 4. The embodiment shown in FIG. 4 illustrates an approach angle 14 defined between the floor or ground 16 and the bottom of the midsole body 20 (as illustrated by line 12). Low-friction material 1 extends along the anterior curve 21 (shown in FIG. 6) of the anterior portion (e.g., forward portion) of the midsole body 20 to ensure contact between the low-friction material 1 and the floor or ground 16 given a non-zero approach angle 14. The anterior curve 21 and the protrusion of the leading edge of the low friction material 17 (shown in FIG. 3) combine to increase the range of approach angles 14 that will result in contact between the low-friction material 1 and the floor or ground 16. The extent to which the low-friction material 1 extends along the anterior curve 21 determines the range of approach angles 14 that will result in contact between the low-friction material 1 and the ground 16. The further the extent of the low-friction material 1 along the anterior curve 21, the greater or larger the approach angle that will result in contact between the low-friction material 1 and the ground 16. The anterior curve 21 also ensures a dominant orthogonal force component between the floor 16 and the low-friction material 1 during late stance known as toe-off.

Figure 5:
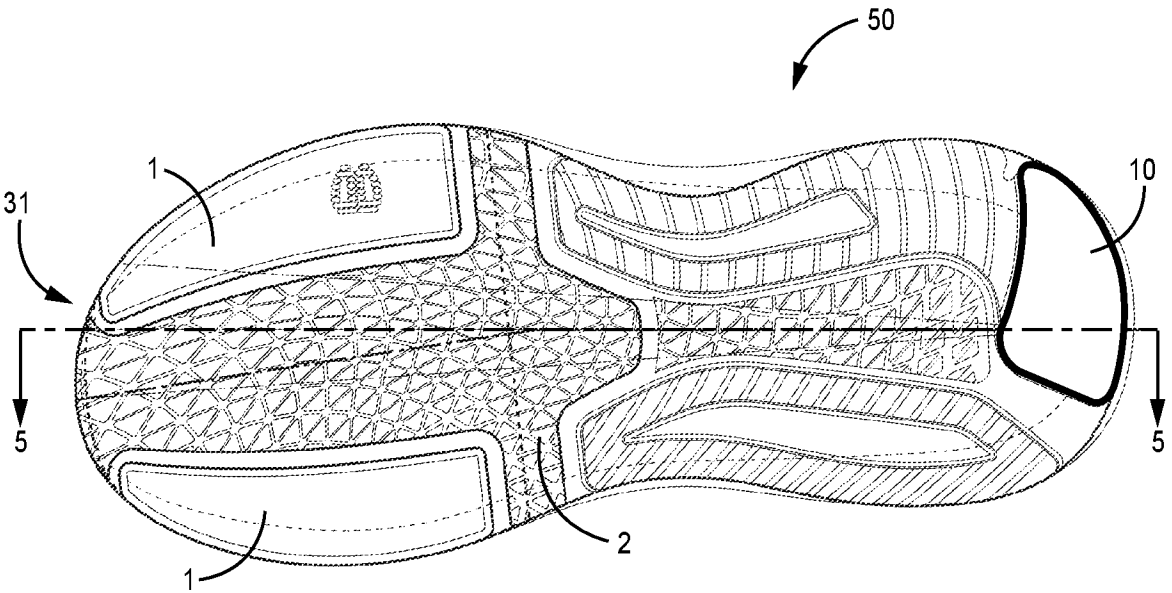
FIG. 5 is a bottom view of an exemplary sole.

FIG. 5 shows the bottom view of the sole 50. In the embodiment shown in FIG. 5, the low-friction material 1 is placed along the anterior portion of the sole 31. In some embodiments, the low-friction material 1 includes two portions located on opposite sides of the sole 31 (e.g., the medial and lateral edges of the sole 31) and separated by high-friction material 2 that extends to the tip of the anterior portion of the sole 31. In some embodiments, extending high-friction material 2 to the tip of the anterior portion of the sole 31 allows the high-friction material 2 to be brought into contact with the ground or floor during toc-off while the low-friction material 1 is pressed into the sole 50. In some embodiments, instead of the high-friction material 2, the intermediate material 3 and/or the bare foam associated with the midsole body 20 may provide a sufficient coefficient of friction. In some embodiments, friction is beneficial during toe-off for the propulsion of gait and for the weight transfer between the toe-off foot and the contralateral limb that is in initial stance at that time, and therefore the tip of the anterior portion of the sole 31 should include a material that includes a higher coefficient of friction than that of the low-friction material 1. In addition, in some embodiments a rear high-friction patch 10 is located at the posterior (i.e., rear) portion of the sole 31. In some embodiment, the high-friction patch 10 includes a higher coefficient of friction than the midsole body 20.

Figure 6:
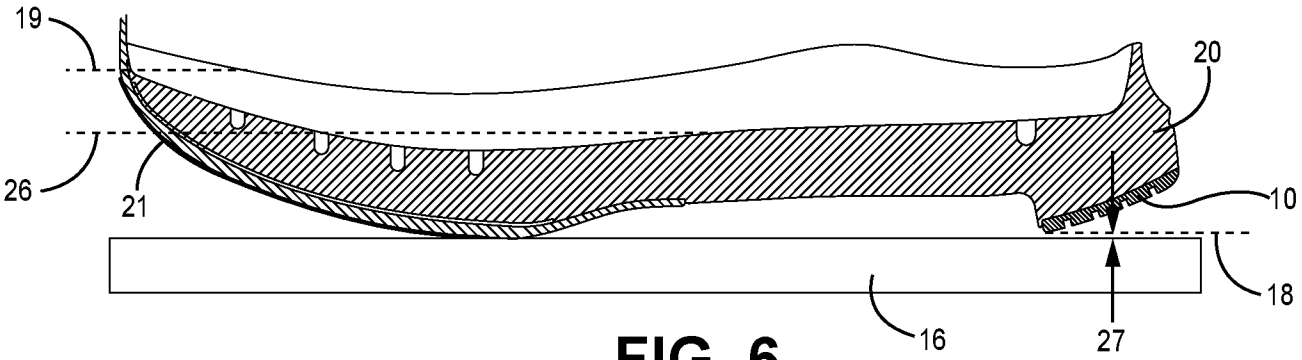
FIG. 6 is a cross-sectional view of an exemplary midsole body.

FIG. 6 is a cross-sectional view of the sole 50 taken through line 5-5 shown in FIG. 5. The cross-sectional view shown in FIG. 6 illustrates the anterior curvature 21 of the midsole body 20 relative to other parts of the midsole body 20. For example, in some embodiments, the anterior curvature 21 terminates at a level shown by the line 19, where the line 19 is above the top of the midfoot shelf as illustrated by line 26. In the embodiment shown in FIG. 6, portion of the midsole extending from the heel to the midfoot area is relatively flat, but in other embodiments this portion may be curved as well. If it is curved, the height of the midfoot shelf 26 is greatest between the middle of the shoe and the rear of the shoe before a transition is made at the rear of the shoe to fit into the upper portion 5. In some embodiments a gap 27 exists between the ground 16 and the bottom most portion of the rear high-friction patch 10 as noted by dotted line 18. In some embodiments, the gap 27 prevents the high-friction patch 10 from coming into contact with the floor or ground 16 during a scuff event (i.e., accidental contact with the floor or ground during the swing part of the gait) during which time the user is making use of the low-friction material 1 coming into contact with the floor 16. That is, during a scuff event, the low-friction material 1 slides along the floor 16 (due to the low-friction) and does not jar or disrupt the user. The gap 27 prevents the high-friction material 10 from coming into contact with the ground and causing a jarring event or fall (as well as preventing a characteristic squeak sound associated with high-friction materials coming into contact with the floor 16).

FIG. 7 is an exemplary exploded view of an exemplary sole 50' that illustrates a combined single-piece intermediate layer 3' and low-friction material 1'. The embodiment shown in FIG. 7 once again includes a midsole body 20, compressible portions 4 located adjacent to the midsole body 20, and a high-friction portion 2. In the embodiment shown in FIG. 7 the low-friction portion or portions 1' and the intermediate layer 3' are integrated into a single piece. The low-friction portion or portions 1' are positioned to be approximately aligned with the compressible portions 4, so that the application GRFs onto the low-friction portion or portions 1' results in the compression of the compressible portion 4 such that the intermediate layer 3' and/or high-friction portion 2 comes into contact with the floor or ground.

Figure 8A:
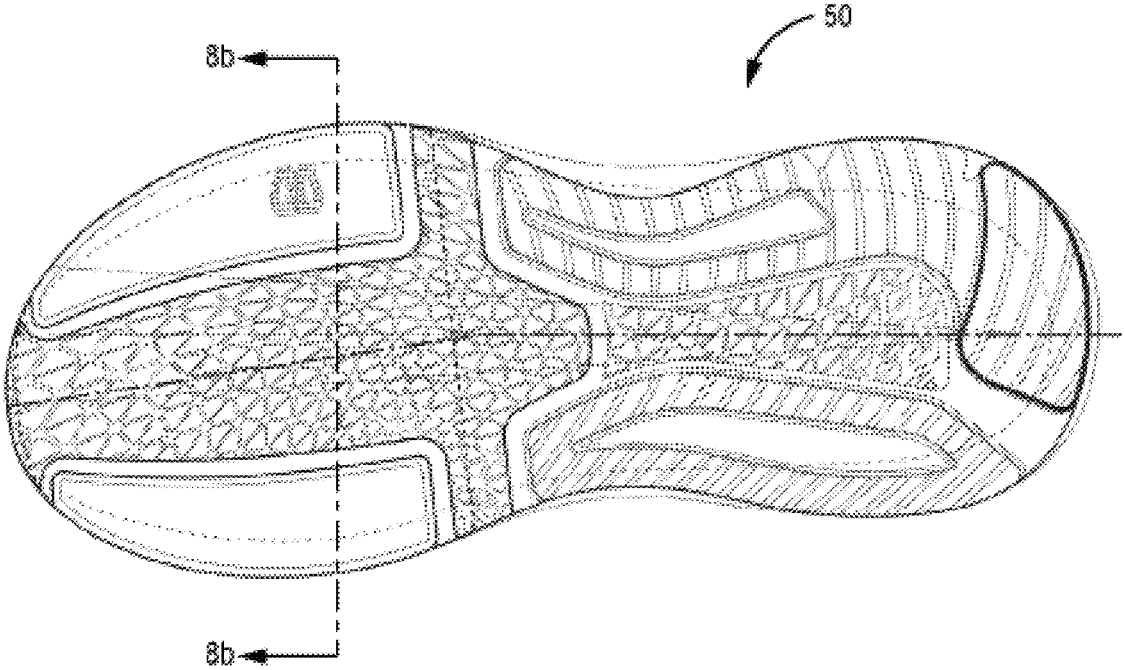
FIG. 8*a* is a bottom view of an exemplary sole.
Figure 8B:
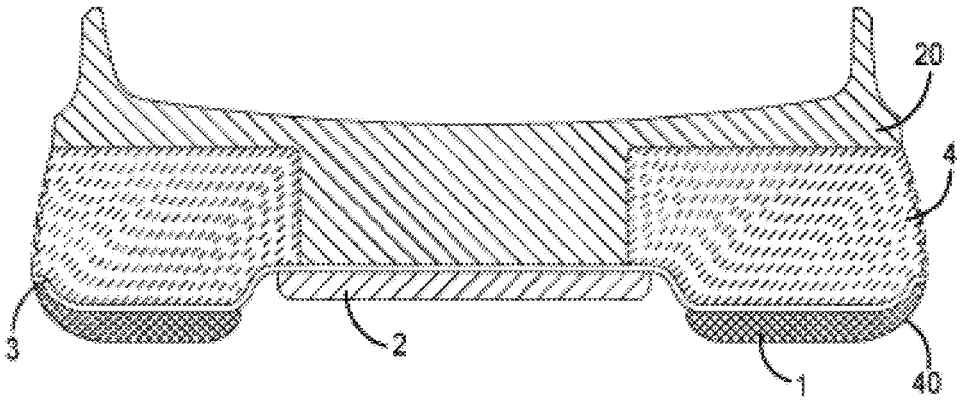
FIG. 8*b* is a cross-sectional view of an exemplary midsole body.

FIG. 8*a* shows the bottom view of the sole 50 and FIG. 8*b* is a cross-sectional view of the sole 50 taken at line 8*b*-8*b* as shown in FIG. 8*a*. In the cross-sectional view shown in FIG. 8*b*, the curvature 40 of the low-friction portions 1 are illustrated. In some embodiments, the curvature 40 is designed to prevent the user from tripping in response to a sideways scuff event in which the side of the shoe 50' comes into contact with the floor or ground during the swing phase of the gait. It is important that this curvature 40 radius is greater than 1 mm.

Several implementations have been described. Nevertheless, it will be understood that various modifications may be made without departing from the spirit and scope of the techniques and devices described herein. Accordingly, other implementations are within the scope of the following claims.

Discussion of Possible Embodiments

The following are non-exclusive descriptions of possible embodiments of the present invention.

According to one aspect, a variable friction shoe sole includes a midsole body, one or more compressible portions comprised of a compressible material, one or more low-friction portions vertically aligned with the one or more compressible portions, and one or more intermediate layers located between the one or more low-friction portions and the one or more compressible portions. The one or more low-friction portions are prominent of the midsole body when vertical ground reaction forces (GRFs) applied to the variable friction shoe sole are low, and wherein an increase in GRFs compresses the one or more compressible portions and causes the one or more low-friction portions to retract inwards.

The variable friction shoe sole of the preceding paragraph can optionally include, additionally and/or alternatively any, one or more of the following features, configurations and/or additional components.

For example, the sole may include a high-friction layer located adjacent to the intermediate layer, wherein the one or more low-friction portions are prominent of the high-friction layer when the one or more compressible portions are in an uncompressed state and wherein the one or more low-friction portions are not prominent of the high-friction layer when the one or more compressible portions are in a compressed state.

The sole may include a rear high-friction patch.

The rear high-friction patch may be located above a plane defined by a bottom of the midsole body.

The one or more low-friction portions may include a first low-friction portion located on the medial edge of the sole and a second low-friction portion located opposite the first low-friction portion on the lateral edge of the sole.

The midsole body may include a midsole shelf and wherein an anterior portion of the outer surface of the midsole may curve upwards and terminate at a point above the midsole shelf.

The one or more low-friction portions may extend along the curve of the anterior portion and terminate at a point above the midsole shelf.

The low-friction material may contact the ground when the sole is in an approach angle of up to 75 degrees.

The one or more compressible portions may be comprised of a material that is more compressible than that of the midsole body.

The one or more low-friction portions may be comprised of a material having a coefficient of friction less than a coefficient of friction associated with the midsole body and/or the one or more intermediate layers.

According to another aspect, a variable friction shoe may include an upper portion, a midsole body connected to the upper portion, the midsole body having a bottom surface that defines a first plane. The shoe may further include one or more compressible portions located adjacent to the midsole body and one or more low-friction portions vertically aligned with the one or more compressible portions. The shoe may further include one or more intermediate layers located between the one or more compressible portions and the one or more low-friction portions, wherein the one or more low friction portions extend below the plane defined by the bottom of the midsole body when zero ground reaction forces (GRFs) are applied to the bottom of the shoe and wherein the one or more low friction portions retract above the plane defined by the bottom of the midsole body in response to a threshold level of GRFs are applied to the bottom of the midsole body.

The variable friction shoe of the preceding paragraph can optionally include, additionally and/or alternatively any, one or more of the following features, configurations and/or additional components.

For example, the variable friction shoe may further include a high-friction layer located underneath the intermediate layer and laterally adjacent to the low-friction material.

The upper portion may include one or more of a Velcro® strap (i.e., a hook and loop fastener), a zipper, and/or laces on the upper.

The midsole body may include a midsole shelf and wherein an anterior portion of the outer surface of the midsole curves upward and terminates at a point above the midsole shelf.

The one or more low-friction portions may extend along the curve of the anterior portion and terminate at a point above the midsole shelf.

According to another aspect, the variable friction shoe sole may include a midsole body, one or more sections of a compressible material that compresses more easily than the midsole body, and one or more sections of a low-friction material assembled such that the low friction material sits beneath the portions of the sole containing the compressible material. The low-friction material may contact the ground when the sole is in an approach angle of up to 75 degrees.

The variable friction shoe sole of the preceding paragraph can optionally include, additionally and/or alternatively any, one or more of the following features, configurations and/or additional components.

For example, the variable friction shoe sole may form a curve in the anterior location such that the anterior curvature termination sits above the midfoot shelf.

The variable friction shoe sole may further include a rear high-friction patch,

The rear high-friction patch may be located above a plane defined by a bottom of the midsole body.

The one or more low-friction portions may include a first low-friction portion located on the medial edge of the sole and a second low-friction portion located opposite the first low-friction portion on the lateral edge of the sole.

What is claimed is:

1. A variable friction shoe comprising:

a midsole body having an anterior portion defining an anterior curve, and a midsole bottom surface having a first coefficient of friction, the midsole bottom surface being defined by a first horizontal plane when the variable friction shoe is in a horizontal, resting position, wherein the midsole bottom surface forms a portion of an outsole of the variable friction shoe; and a low-friction outsole material located at the anterior portion of the midsole body, the low-friction outsole material being shaped to follow the anterior curve and forming a low-friction bottom surface defined by a second horizontal plane, wherein when the variable friction shoe is in the horizontal, resting position and vertical ground reaction forces (GRFs) applied to the variable friction shoe are less than a first value, the second horizontal plane is located below the first horizontal plane as a result of the low-friction bottom surface protruding below the midsole bottom surface, the low-friction outsole material having a second coefficient of friction less than the first coefficient of friction;

wherein the low-friction bottom surface is configured to protrude beyond the midsole bottom surface of the midsole body when the vertical GRFs applied to the variable friction shoe are equal to or less than the first value, and wherein the low-friction bottom surface of the low-friction outsole material is configured to retract inwards towards the midsole body when the vertical GRFs are greater than the first value, wherein the midsole bottom surface is configured to make contact with a ground surface when the low-friction outsole material is retracted inwards in response to the vertical GRFs exceeding the first value.

2. The variable friction shoe of claim 1, wherein the midsole body has a midfoot shelf and wherein the anterior curve terminates at a level above a top portion of the midfoot shelf.

3. The variable friction shoe of claim 1, wherein the low-fiction outsole material located at the anterior portion of the midsole body is configured to protrude beyond the midsole bottom surface of the midsole body at non-zero approach angles of the anterior portion to the ground surface.

4. The variable friction shoe of claim 3, wherein the anterior curve is configured to produce a dominant orthogonal force component between the ground surface and the low-friction outsole material during toe-off.

5. The variable friction shoe of claim 1, wherein the low-friction outsole material is located on at least one of an anterior lateral edge and an anterior medial edge of the variable friction shoe.

6. The variable friction shoe of claim 5, wherein the low-friction outsole material located on at least one of the anterior lateral edge and the anterior medial edge has a radius of curvature greater than 1 mm.

7. The variable friction shoe of claim 6, wherein the radius of curvature of at least one of the anterior lateral edge and the anterior medial edge is configured to prevent tripping in response to a sideways scuff.

8. The variable friction shoe of claim 1, further including a rear high-friction patch having a third coefficient of friction greater than the second coefficient of friction, wherein the rear patch is configured to be located above the first horizontal plane defined by the midsole bottom surface of the midsole body.

9. A variable friction shoe comprising:

a midsole body having an anterior portion that defines an anterior curve; and a low-friction material located at the anterior portion of the midsole body and having a geometry that follows the anterior portion along the anterior curve, the low-fiction material having a bottom surface defined by a first coefficient of friction;

a high friction material defined by a second coefficient of friction that is greater than the first coefficient of friction, the high friction material defining a bottom surface of a portion of the midsole body, wherein the portion of the midsole body forms a portion of an outsole of the variable friction shoe;

wherein the bottom surface of the low-friction material is configured to protrude beyond the bottom surface of the portion of the midsole body including the high friction material when vertical ground reaction forces (GRFs) applied to the variable friction shoe are less than a first value, and wherein the bottom surface of the low-friction material is configured to retract inwards towards the midsole body when the vertical GRFs are greater than the first value, wherein the bottom surface of the portion of the midsole body including the high friction material is located and configured to make contact with a ground surface in response to the vertical GRFs being greater than the first value.

10. The variable friction shoe of claim 9, wherein the midsole body has a midfoot shelf and wherein the anterior curve terminates at a level above a top portion of the midfoot shelf.

11. The variable friction shoe of claim 9, wherein the bottom surface of the low-friction material located at the anterior portion of the midsole body is configured to protrude beyond the bottom surface of the portion of the midsole body that includes the high friction material when the vertical GRFs are equal to or less than the first value.

12. The variable friction shoe of claim 11, wherein the anterior curve is configured to produce a dominant orthogonal force component between the ground surface and the low-friction material during toe-off.

13. The variable friction shoe of claim 9, wherein the low-friction material is located on at least one of an anterior lateral edge and an anterior medial edge of the variable friction shoe.

14. The variable friction shoe of claim 13, wherein the low-friction material located on the at least one of the anterior lateral edge and the anterior medial edge has a radius of curvature greater than 1 mm.

15. The variable friction shoe of claim 14, wherein the radius of curvature of the at least one of the anterior lateral edge and the anterior medial edge is configured to prevent tripping in response to a sideways scuff.

16. The variable friction shoe of claim 9, further including a rear high-friction patch having a third coefficient of friction greater than the second coefficient of friction, wherein the rear high-friction patch is located above a plane defined by the bottom surface of the portion of the midsole body.

* * * * *